US006789361B1

(12) United States Patent
Spartz et al.

(10) Patent No.: US 6,789,361 B1
(45) Date of Patent: Sep. 14, 2004

(54) GARAGE/CARPORT FOR MANUFACTURED HOMES

(76) Inventors: Jason M. Spartz, 102 Natasha Dr., Noblesville, IN (US) 46060; Daniel C. Spartz, 296 Ashbourne Dr., Noblesville, IN (US) 46060; Charles N. Spartz, 15909 Summer Rd., Noblesville, IN (US) 46060

( * ) Notice: Subject to any disclaimer, the term of this patent is extended or adjusted under 35 U.S.C. 154(b) by 51 days.

(21) Appl. No.: 10/193,018

(22) Filed: Jul. 11, 2002

Related U.S. Application Data

(60) Provisional application No. 60/304,729, filed on Jul. 11, 2001.

(51) Int. Cl.[7] ..... E04H 1/00; E04H 14/00; E04H 3/00; E04H 5/00; E04H 6/00

(52) U.S. Cl. ..... 52/79.9; 52/79.6; 52/143; 52/121; 52/67; 52/DIG. 11

(58) Field of Search ..... 52/79.7, 79.9, 52/79.6, 143, 169.3, 169.2, 121, 67, 64, DIG. 11, 79.5; 296/26.04, 26.05, 225

(56) References Cited

U.S. PATENT DOCUMENTS 2,706,313 A * 4/1955 Radman ..... 52/79.9
3,157,427 A * 11/1964 Reynold ..... 296/168
4,078,343 A * 3/1978 Moore, Jr. ..... 52/79.1
4,114,328 A * 9/1978 Lawrence ..... 52/79.1
4,222,207 A * 9/1980 Latimer et al. ..... 52/169.3
4,327,529 A * 5/1982 Bigelow et al. ..... 52/34
4,501,098 A * 2/1985 Gregory ..... 52/79.1
4,685,260 A * 8/1987 Jenn ..... 52/169.3
5,237,784 A * 8/1993 Ros ..... 52/79.5
5,374,094 A * 12/1994 Smith et al. ..... 296/26.05
5,950,373 A * 9/1999 von Hoff et al. ..... 52/79.5

* cited by examiner

*Primary Examiner*—Carl D. Friedman
*Assistant Examiner*—Chi Q Nguyen
(74) *Attorney, Agent, or Firm*—Woodard, Emhardt, Moriarty, McNett & Henry LLP

(57) ABSTRACT

In the present invention, a removable support member factory built garage/carport has a design that allows for the support members and associated support structures to be removed from the garage area during the installation process. During this process, the weight of the garage is transferred to the foundation and then the garage support members are removed from the garage area while the rails are left intact under the home. This allows the concrete garage floor to be poured at any desired level, before or after the home is installed.

19 Claims, 7 Drawing Sheets

GARAGE/CARPORT FOR MANUFACTURED HOMES

CROSS-REFERENCE TO RELATED APPLICATIONS

The present application claims priority from U.S. Provisional Patent Application Serial No. 60/304,729, filed Jul. 11, 2001, the entire specification and drawings of which are hereby incorporated by reference.

TECHNICAL FIELD OF THE INVENTION

The present invention generally relates to manufactured homes and, more particularly, to a garage/carport for manufactured homes.

BACKGROUND OF THE INVENTION

The U.S. Department of Housing and Urban Development (HUD) oversees the building codes for most manufactured homes, unlike site-built housing that is regulated by local building codes. HUD Code homes (a.k.a. mobile homes, manufactured homes, factory built homes, etc.) sell in the U.S. for a multitude of reasons. Most of these reasons are linked to the fact that it is far more efficient to build a home in a factory than on-site. However, for the most part, the HUD Code home factories have left the construction of a garage to on-site carpenters (as used herein, the term "garage" includes both enclosed garages and semi-enclosed carports). This poses a few major problems.

In rural areas where many of HUD Code homes are sold, it is very difficult to locate and coordinate skilled craftsman to erect and complete any structure. Therefore, a factory built home without an accompanying factory built garage is only a partial solution.

Factory home/garage construction has several advantages over the site built alternative. First, the factory has enormous buying power which enables them to purchase building materials in bulk at a significant savings. Significantly, in the construction of HUD Code homes weather is not a factory and a manufacturing plant can even run multiple shifts in a single day if necessary because of their lighted interior workspace. On-site theft and degradation of materials to weather elements is greatly reduced. A controlled environment leads to a more stable workforce of skilled craftsmen since they are more likely to remain employed during the winter months. Furthermore, with the home and garage built at the same time, the result is a perfect match of shingles and siding which is sometimes difficult to achieve on-site. A factory built home with an attached factory built garage would be far more efficient with labor and materials than building the garage on-site, which would lead to lower cost for the consumer.

All HUD Code homes are built on top of some form of a frame. Usually this consists of two steel I-beams running parallel to one another along the longitudinal length of the home section. This is repeated for each section to be towed on the road. These I-beams, known as frame rails, provide a major portion of the home's rigidity, enabling it to be transported without threat of a structural collapse. Once the home reaches its destination, the proper blocking is installed under the frame rails to ensure the home is level and well supported. The frame rails stay in place in relation to the rest of the home even after it has been placed on its foundation.

The concept of a factory built garage is not new. In a previous attempt by Commodore Corp. (displayed at the 2001 Louisville tradeshow), the frame rails extended through the integrally manufactured garage floor area and then a concrete floor was to be poured over them "on-site." This leads to making a mobile home very immobile and is undesirable for several other reasons. In this prior art design, the garage floor must be formed at least at the height of the top of the frame rails and can only be poured after the home and garage are installed upon their foundation. This prior art design therefore forces the level of the garage floor to be equal to the level of the home's floor, which is typically significantly above grade. This causes difficulties in transitioning from the driveway surface level to the garage floor level. Furthermore, this design requires pouring the garage floor concrete after the home has been set on the foundation. Because installation crews are often non-local contractors who prefer to complete the set up of each home very quickly having to pour the garage floor after set up causes scheduling concerns.

Both Delk in U.S. Pat. No. 4,258,512 and Latimer in U.S. Pat. No. 4,222,207 refer to mobile homes and garages specifically. However, both patents reflect improvements in home design or layout and state that the garage is to be built "on-site." Neither patent shows a factory-built garage.

The mobile home with integral garage in U.S. Pat. No. 3,961,716 to Renaud shows what could better be referred to as a recreational vehicle with rear area in which an automobile can be transported. This also does not reflect a HUD Code home.

Bigelow in U.S. Pat. No. 4,327,529 displays a prefabricated, fold-out house that is transported in a box which will later serve as a garage or large room. Although it could be inferred that the prefabricated house is built in a factory, there is no mention of frame rails and the spirit of the Bigelow invention is more one of panelized home construction concepts.

There is therefore a need for a HUD Code home design that includes a factory-built garage, but which avoids the problems inherent in the prior art designs. The present invention is directed toward meeting this need.

SUMMARY OF THE INVENTION

In the present invention, a removable support member factory built garage/carport has a design that allows for the support members and associated support structures to be removed from the garage area during the installation process. During this process, the weight of the garage is transferred to the foundation and then the garage support members are removed from the garage area while the frame rails are left intact under the home. This allows the concrete garage floor to be poured at any desired level, irrespective of the level of the top of the home's frame rails. Also, the garage floor slab can be poured prior to arrival of the home on-site.

In the present invention, the garage is built at the factory side by side, as one integral unit, with the home on garage support members which couple to the home frame rails. During the initial construction, it is most advantageous for the set-up crew if there is a break between the frame rails and the garage support structure using bolts and side plates (although several other procedures would achieve the desired affect). The garage itself is then constructed atop the garage support members and support member outriggers in a temporary manner so as to give support during transit but allowing for the eventual removal of the garage support members and support member outriggers during installation of the home. Upon the arrival at its destination, the home is set-up in the same fashion as an ordinary HUD home. For most applications, the garage is most desirable if built with perimeter walls that are "telescopic" on the bottom to accommodate varying foundation heights. As is known in the art, this can be achieved with a special metal stud or with wood construction. This telescopic wall is lowered, then fixed in place to receive the weight of the garage itself before the garage support members are removed. If desired, this design would permit the reattachment of the garage support members so the home could be transported again.

The garage support member removal is best achieved by removing the bolts of the side-plates holding the frame rails under the home to support members under the garage. Also, it may be desirable to the installer if there were multiple breaks in each support member. This would give each segment a more manageable size. However, other methods can be employed to remove the support members from the garage area. These other methods include the use of a cutting torch, metal cutting saw, a multitude of quick attach methods, or simply removing bolts in a "step-down frame" version of this design, etc. This invention can have many variations. The garage structure can be on the front or end of a home. The garage support members can be attached in-line, side-by-side, or step-down in relation to the permanent home frame rails. Also, when the garage support member is removed, it is to be assumed that obvious auxiliary support structures will also be removed (i.e. support member outriggers, temporary floor joist, bracing material, support member crossmembers). Furthermore, each support member frame section could be swung or hinged up onto a sidewall so as to "move" the garage support member and not "remove" the garage support member for convenient storage. The garage can be of any size and on any size of home (single or multi-section, one or multiple story). The garage can also employ a multitude of building materials. Also, the process of filling the "void" between the garage and the foundation can take many forms (i.e. telescoping studs, knee wall, etc.). Although, some configurations designed to be placed upon crawl space or basement foundations would not require a telescopic wall. Furthermore, this garage could simply be considered a carport if the door were omitted or posts were put in place instead of a wall to receive the weight of the structure as the support members were moved.

DETAILED DESCRIPTION OF THE PREFERRED EMBODIMENTS

Figure 1:
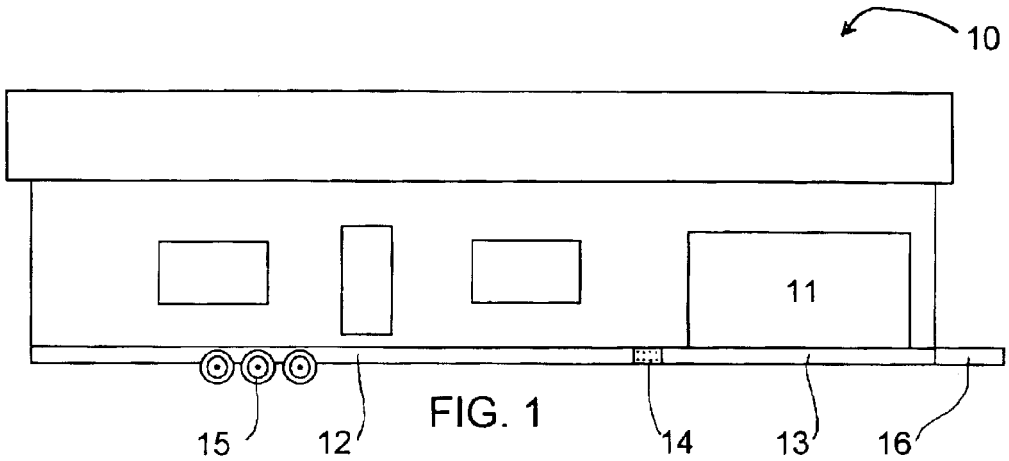
FIG. 1 is a front side view of a home before installation with a garage built in accordance with a first embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Referring to FIG. 1, there is illustrated a first embodiment of the present invention, indicated generally at 10, which is HUD Code home of the "front elevation" style. In a front elevation home, the garage opening is on one of the long sides of the home.

FIG. 1 shows the home as it appears in transit. This perspective shows the home frame rail 12, which is permanently attached to the home, and a garage support member 13 which will be removed during installation of the home upon its foundation. As used herein, "garage" refers to either a HUD Code garage or a non-HUD Code factory-built garage attached to the home. As used herein, "garage support member" refers to either a removable frame rail section located under the garage, or to an elongated removable hitch, a portion of which extends under the garage. In either case, the garage support member is to be removed during or after installation of the home upon its foundation. Also visible is the point of temporary union 14 of the home frame rail 12 to the garage support member 13. During installation, the garage support members 13 will be removed after the weight of the garage has been transferred to the foundation via an expandable wall, knee-wall or sill plate, etc.

Figure 8:
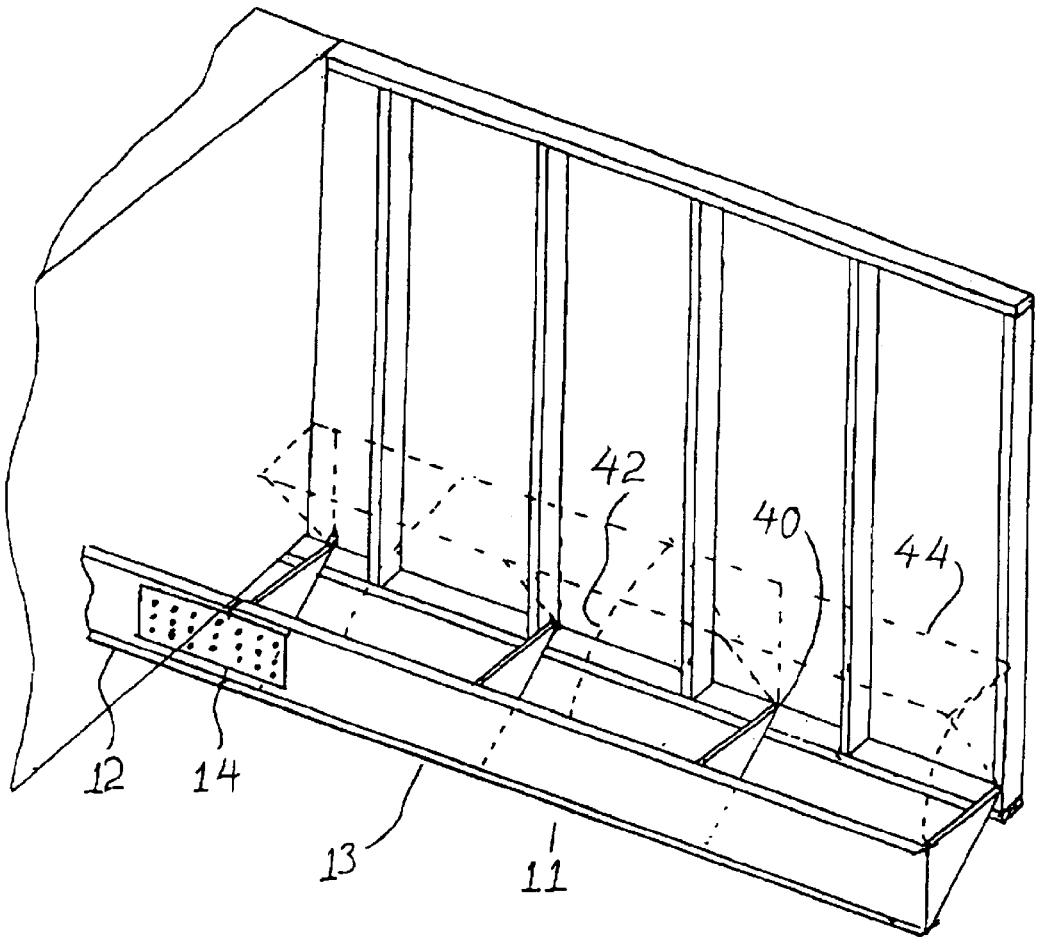
FIG. 8 is a cutaway view of the garage support structure assembly showing a hinge that allows the support structure to pivot to a storage position.
Figure 9:
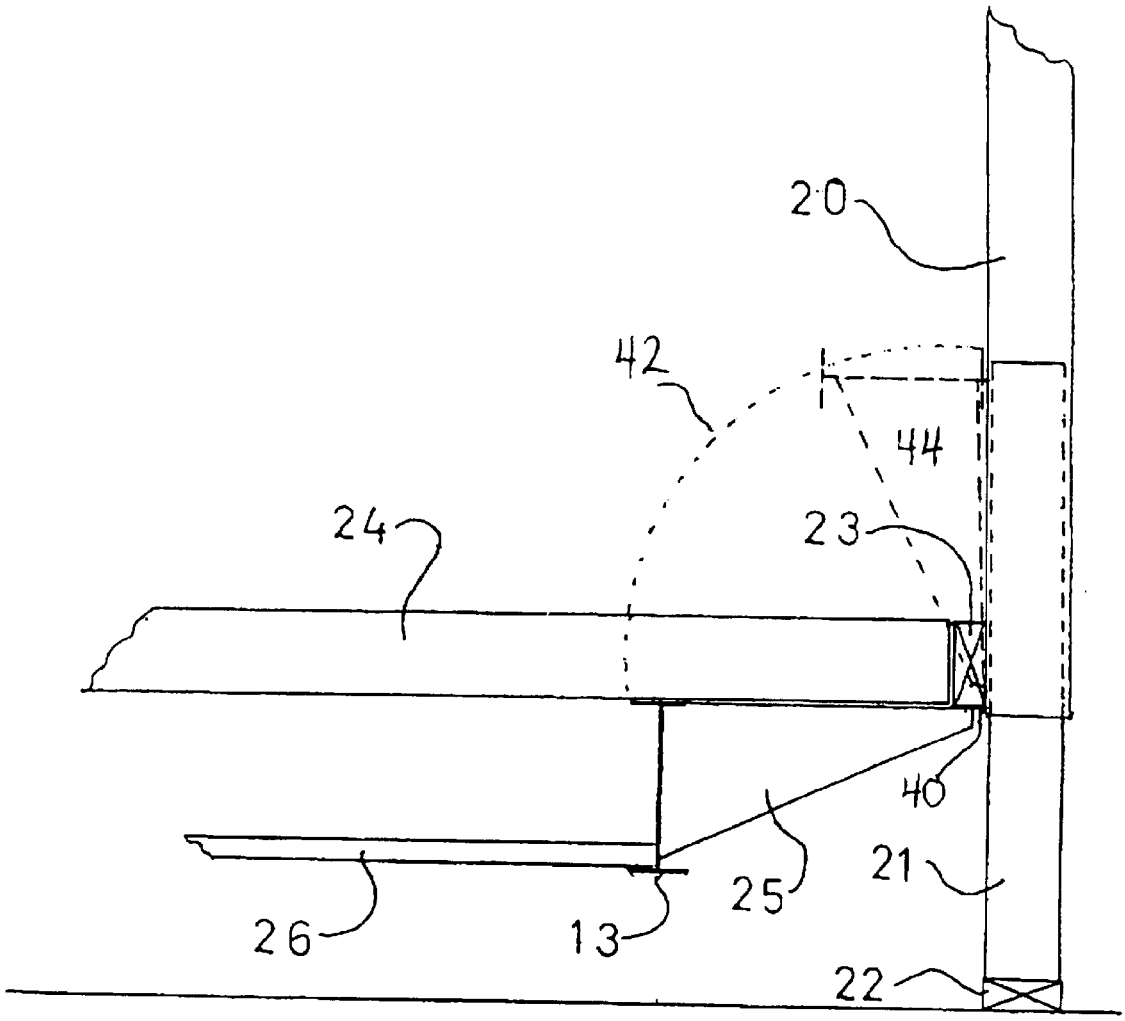
FIG. 9 is a cross-sectional view of the garage support structure assembly with a wood expandable wall in the lowered stage, and a hinge that allows the support structure to pivot to a storage position.

As discussed hereinabove, the point of temporary union 14 may comprise a bolted junction employing side-plates and bolts, or other means of temporary attachment. Alternatively, the point of temporary union 14 may be a point on an integral frame rail 12/garage support member 13 designated by the manufacturer of the home as a point for severing the garage support member 13 during installation of the home using, for example, a cutting torch, metal cutting saw, etc. As shown in FIGS. 8 and 9, the point of temporary union 14 may be hinged 40 so that the garage support member 13 may be pivoted along a pivot path 42 up to a storage position 44 above the level of the garage floor.

The most cost efficient production of this home/garage would likely be achieved with the garage constructed as a continuation of the same roofline as the home as displayed in FIG. 1. However, a different roofline or roof pitch could be used between the two to give a more desirable appearance. FIG. 1 shows the tires 15 and hitch mount 16 which are to be removed during installation. The tires and hitch could be located at either end of the home. Also, a wide array of hitch designs and configurations could be used.

Figure 2:
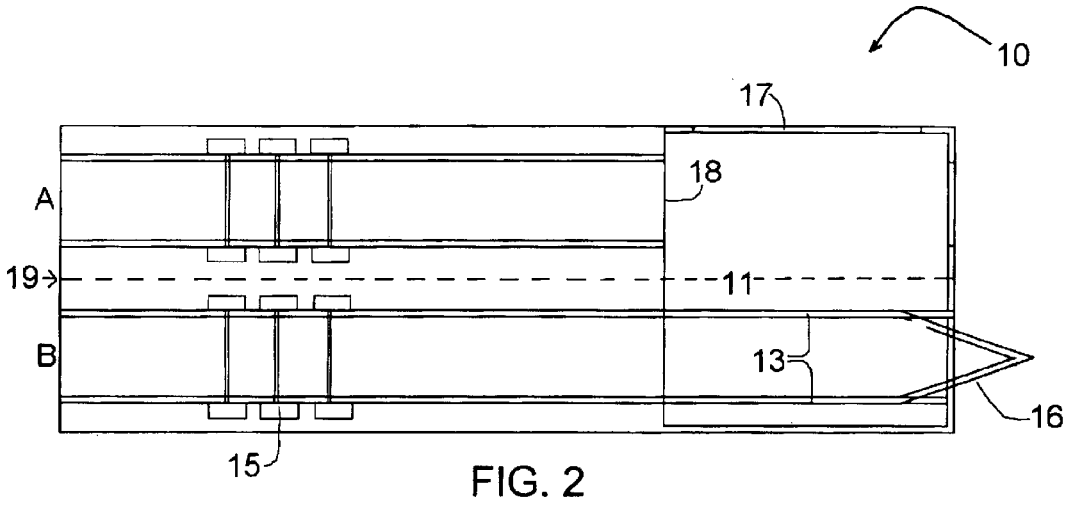
FIG. 2 is a bottom plan view of the home of FIG. 1 in a semi-complete stage of installation.

FIG. 2 is a bottom plan view of the home/garage 10 of FIG. 1 with the installation process partially complete. This particular home 10 is comprised of two sections which are combined during the installation process. This perspective shows two of the garage support members 13 and the hitch mount 16 removed from section A. Still present but yet to be removed are the two garage support members 13 and hitch mount 16 from Section B. Once this process is complete, the garage 11 area will be unobstructed by the presence of the garage support members as well as associated support structure and a vehicle will be able to enter through the garage door opening 17. The garage door opening could also be located on the end or rear of the home while still remaining essentially the same invention. Also visible from this perspective is the wall 18 between the garage and home as well as the point of union 19 between sections A and B. The blocking of the home is not shown in this display, also, the tires 15 are still shown in place although most installers would have removed them by this point in the installation process.

Figure 3:
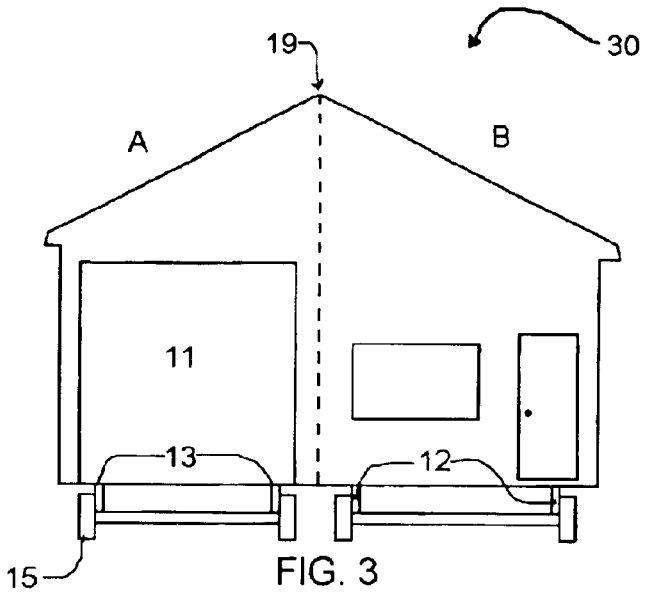
FIG. 3 is a side view of a home before installation with a garage built in accordance with a second embodiment of the present invention.

Referring now to FIG. 3, there is illustrated a second embodiment of the present invention, indicated generally at 30, which is a HUD Code home of the "end elevation" style. In an end elevation home, the garage opening is on one of the short sides of the home.

FIG. 3 shows a smaller (1-car) garage than displayed in FIGS. 1 and 2. In FIG. 3 the garage 11 is located only in section A. Also visible from this perspective are the home frame rails 12 of section B and the removable garage support members 13 of section A. The point of union 19 between section A and B can also be seen in this view. The blocking of the home is not shown in this view. Also, the tires 15 are still shown in place although most installers would have removed them by this point in the installation process. Furthermore, for ease of viewing, the hitch mount 16 is not shown.

Figure 4:
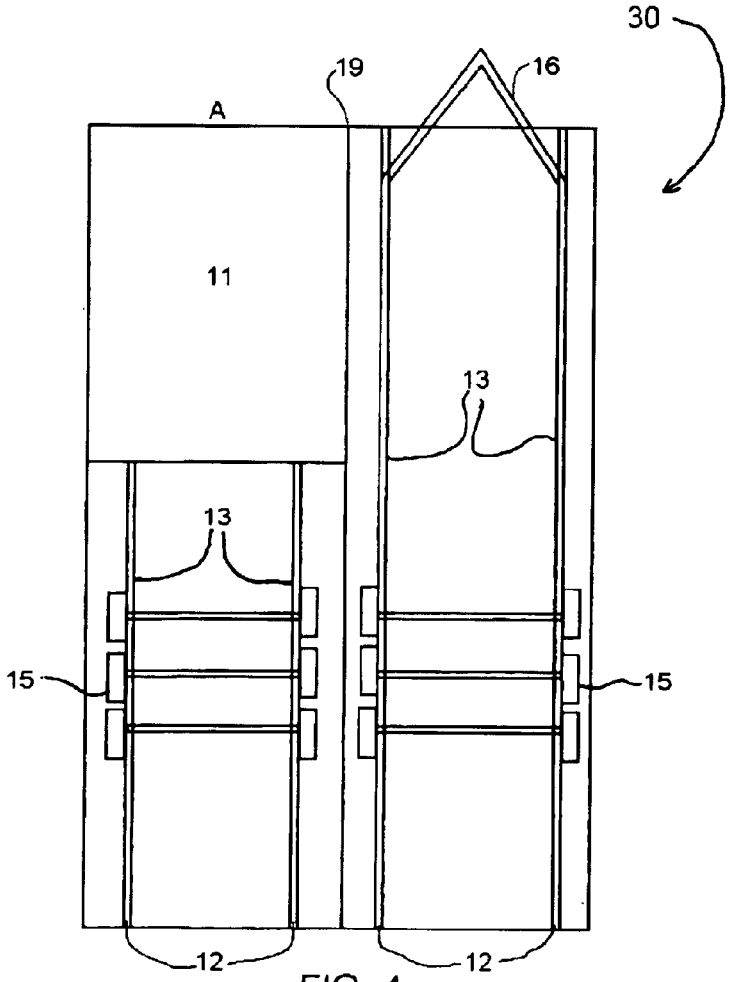
FIG. 4 is a bottom plan view of the home of FIG. 3 during the process of installation.

FIG. 4 is a bottom plan view of the home 30 in FIG. 3 during the installation process. Apparent from this perspective is the previous removal of the garage support members 13 of section A. Also visible in this drawing are the permanent home frame rails 12 of section B, the hitch mount 16 of section B, and the garage 11 area, and the permanent frame rails 12 of section A. Also, one can see the point of union 19 between sections A and B. This end elevation example 30 requires that only two garage support members be removed to complete the garage 11, whereas the first embodiment home 10 requires the removal of four garage support members to complete the installation of the front elevation garage. However, on larger width homes it would be practical to achieve an acceptable garage depth by designing a floor plan where only two or three garage support members are removed, thereby permitting more living area to the rear of the garage 11.

Figure 5:
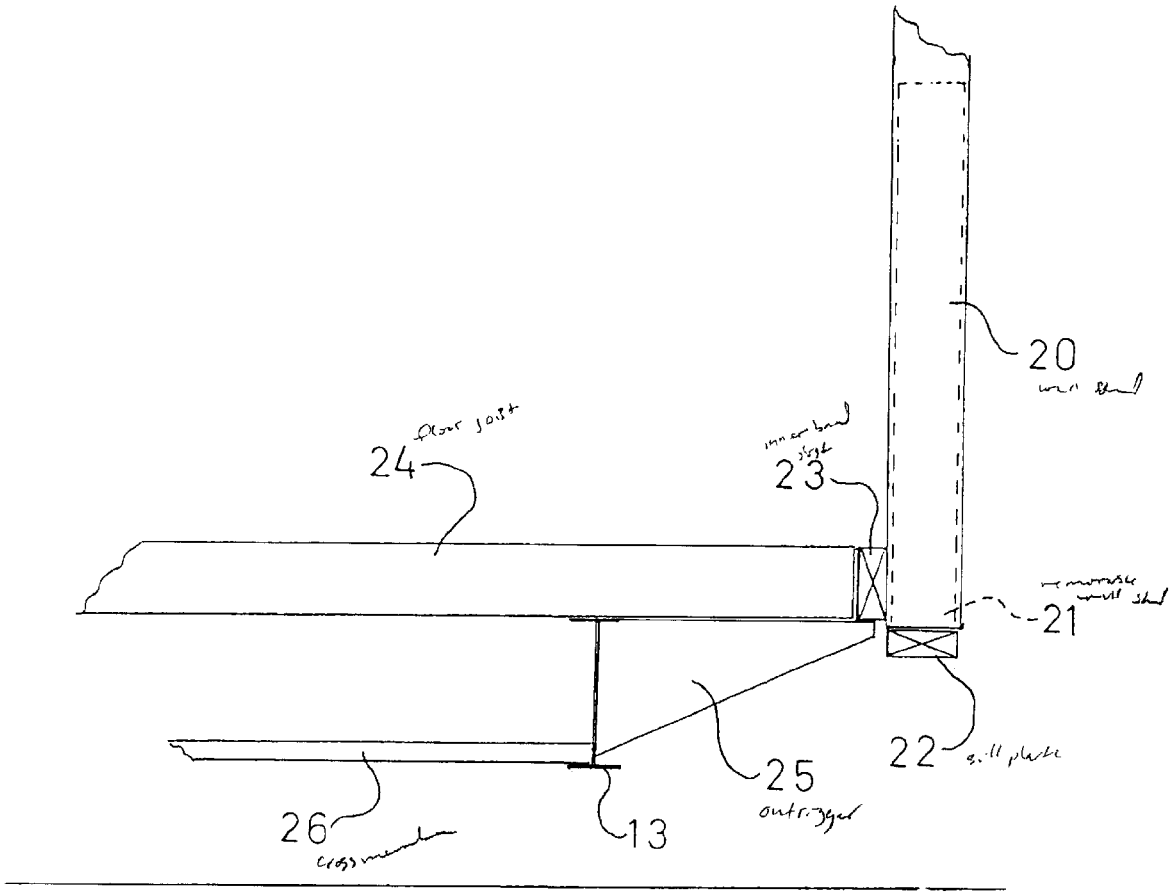
FIG. 5 is a cross-sectional view of the garage support structure assembly with a wood expandable wall in the raised, shipping position constructed in accordance with one embodiment of the present invention.

FIG. 5 is a cross-sectional view of the garage frame assembly with a wood expandable wall in the raised, shipping position. Visible from this perspective is the removable garage support member 13 and the attached outrigger 25 and crossmember 26. During transit, this combined support assembly will provide support and structural integrity to the temporary floor joists 24 which are bonded together by the inner band board/rim joist 23. The inner band board/rim joist 23 is attached to the inside of the stationary wall studs 20. Raised and non-functional at this stage are the movable wall studs 21 and the bottom/sill plate 22. The preferred method for constructing the expandable wall would include the use of pressure treated lumber for the movable wall studs 21 and the bottom/sill plate 22. Also, it would be most advantageous if the movable wall studs 21 were ripped slightly (made somewhat narrower) to eliminate any friction between them and the inner band board/rim joist 23 and the outer wall sheathing (not shown).

Figure 6:
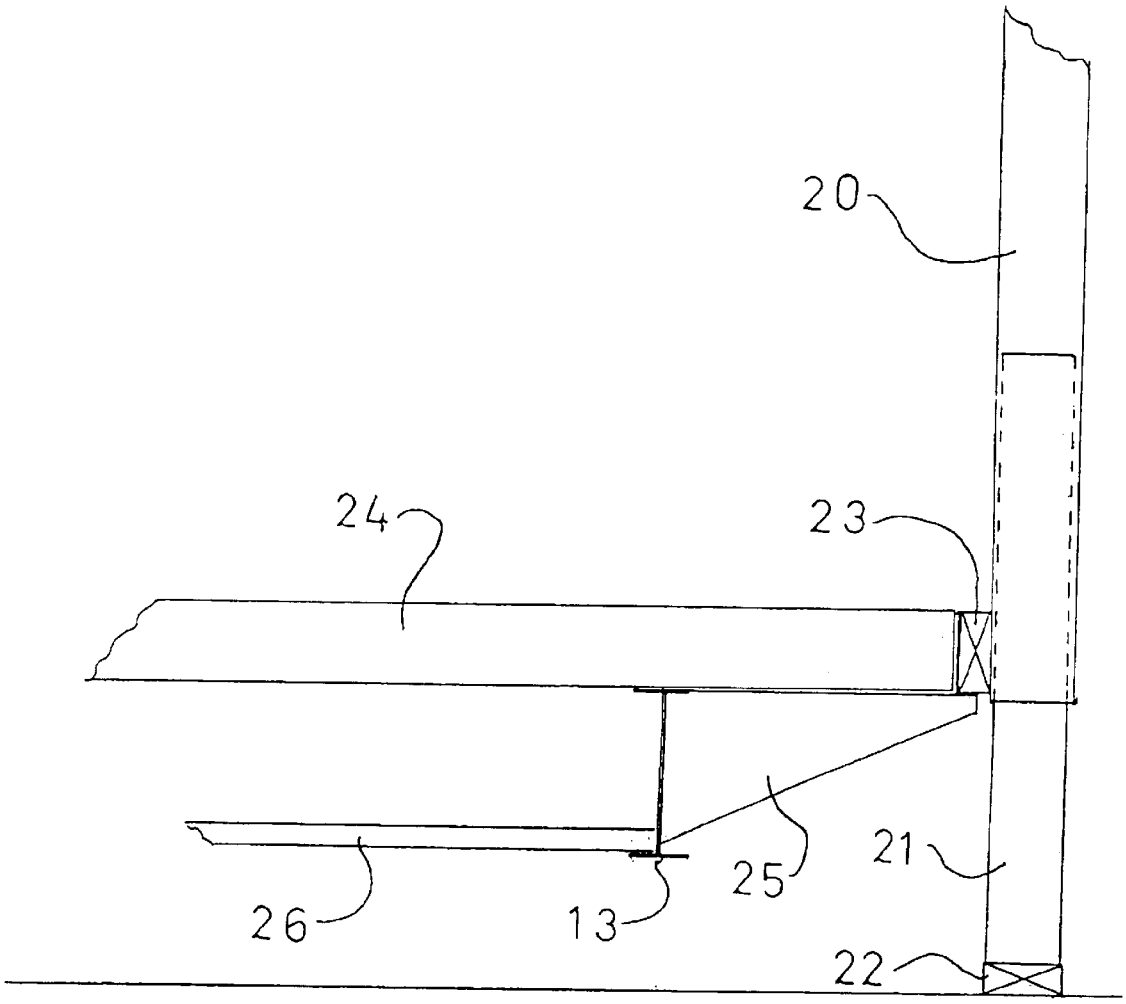
FIG. 6 is a cross-sectional view of the garage support structure assembly with a wood expandable wall of FIG. 5 in the lowered stage during home installation.

As shown in FIG. 6, once the home 10, 30 has been positioned upon its foundation, the movable wall studs 21 are lowered such that the bottom/sill plate 22 rests upon the foundation. The movable wall studs 21 can then be securely fastened to the stationary wall studs 20 in a fashion to provide adequate vertical and horizontal strength. The garage support members 13 can then be removed by severing them from the frame rails 12 at the point of temporary union 14. Any other temporary support items, such as temporary floor joists 24, outriggers 25 and crossmembers 26, can also be removed at this time. Finally, the movable wall studs 21 can be covered with any desired exterior structural or cosmetic sheathing.

Figure 7:
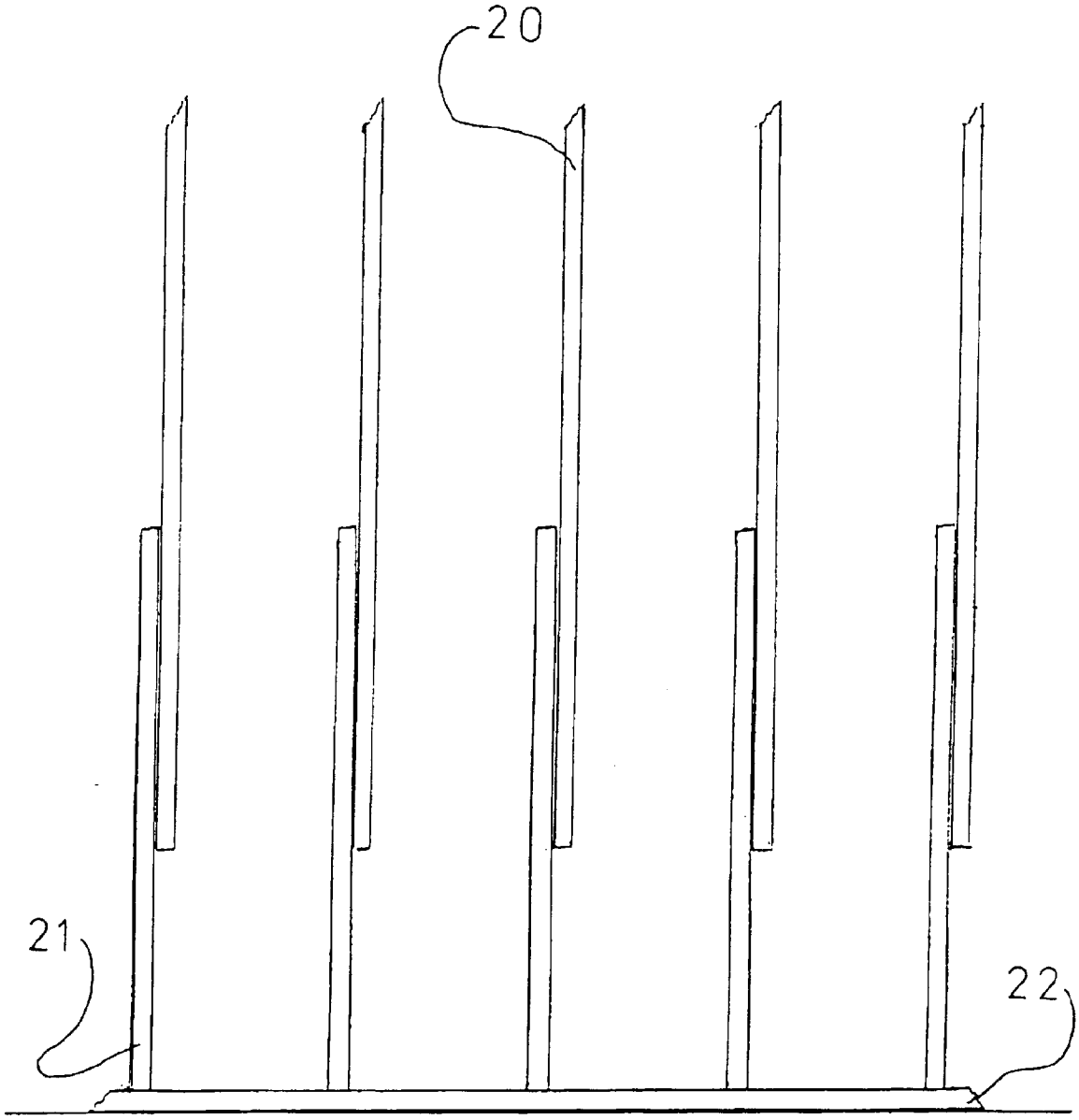
FIG. 7 is a simplified side elevational view of a wood expandable wall constructed in accordance with one embodiment of the present invention.

FIG. 7 is a side view of the wood expandable wall of FIGS. 5 and 6. Visible in this drawing are the stationary wall studs 20, the movable wall studs 21, and the bottom/sill plate 22. This perspective reveals the simple vertical movement of the wall. Another very practical mechanism for an expandable wall is the use of a specialized metal telescoping stud that fastens to the side of the stationary wall stud 20. Once lowered, this metal design can be locked in place with the aid of a fastener.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A HUD Code home, comprising:

a living area;

a garage adjacent the living area;

at least one frame rail extending under the living area;

at least one garage support member extending under the garage;

at least one point of temporary union joining each of the at least one frame rails to respective ones of the at least one garage support members; and wherein the at least one garage support member is operative to be removed from under the garage after the home has been placed upon its foundation by severing the point of temporary union.

2. The HUD Code home of claim 1, wherein the at least one garage support member comprises at least one frame rail.

3. The HUD Code home of claim 1, wherein the at least one garage support member comprises at least one removable elongated hitch.

4. The HUD Code home of claim 1, wherein the at least one point of temporary union comprises a plurality of side plates and a plurality of bolts.

5. A HUD Code home, comprising:

a living area;

a garage adjacent the living area;

at least one frame rail extending under the living area;

at least one garage support member extending under the garage;

wherein the at least one garage support member is operative to be removed from under the garage after the home has been placed upon its foundation; and at least one telescoping wall operative to extend down to the foundation after the home has been placed upon the foundation.

6. A HUD Code home, comprising:

a living area;

a garage adjacent the living area;

at least one frame rail extending under the living area;

at least one garage support member extending under the garage;

at least one point of temporary union joining each of the at least one frame rails to respective ones of the at least one garage support members; and wherein the point of temporary union comprises at least one hinge operative to allow the at least one garage support member to pivot out from under the garage.

7. A HUD Code garage, comprising:

a garage enclosure comprising a roof and a plurality of vertical studs;

at least one garage support member extending under the garage enclosure, wherein the at least one garage support member is operative to support the garage enclosure during transportation of the garage; and wherein the at least one garage support member is operative to be removed from under the garage after the garage has been placed upon its foundation.

8. The HUD Code garage of claim 7, wherein the at least one garage support member comprises at least one frame rail.

9. The HUD Code garage of claim 7, wherein the at least one garage support member comprises at least one removable elongated hitch.

10. A HUD Code garage, comprising:

a garage enclosure comprising a roof and a plurality of vertical studs;

at least one garage support member extending under the garage enclosure, wherein the at least one garage support member is operative to support the garage enclosure during transportation of the garage;

wherein the at least one garage support member may be removed from under the garage after the garage has been placed upon its foundation; and at least one telescoping wall operative to extend down to a foundation upon which the garage is placed.

11. A HUD Code garage, comprising:

a garage enclosure comprising a roof and a plurality of vertical studs;

at least one garage support member extending under the garage enclosure, wherein the at least one garage support member is operative to support the garage enclosure during transportation of the garage; and wherein the at least one garage support member is operative to pivot out from under the garage.

12. A method of installing a manufactured home having a living area, at least one frame rail extending under the living area, a garage adjacent the living area, at least one garage support member extending under the garage, and at least one point of temporary union joining each of the at least one frame rails to respective ones of the at least one garage support members, the method comprising the steps of:

a) placing the manufactured home upon a foundation;

b) severing the at least one point of temporary union; and c) removing the at least one garage support member from under the garage.

13. The method of claim 12, wherein the at least one garage support member comprises at least one frame rail.

14. The method of claim 12, wherein the at least one garage support member comprises at least one removable elongated hitch.

15. The method of claim 12, wherein step (b) further comprises:

b.1) removing a plurality of bolts joining a plurality of side plates to the at least one frame rail and the at least one garage support member; and b.2) removing the plurality of side plates.

16. The method of claim 12, wherein step (b) further comprises cutting through the point of temporary union.

17. The method of claim 16, wherein step (b) further comprises cutting through the point of temporary union with a cutting torch.

18. The method of claim 16, wherein step (b) further comprises cutting through the point of temporary union with a metal cutting saw.

19. A method of installing a manufactured home having a living area at least one frame rail extended under the living area, a garage adjacent the living area, at least one garage support member extending under the garage, and at least one point of temporary union joining each of the at least one frame rails to respective ones of the at least one garage support members, the method comprising the steps of:

a) placing the manufactured home upon a foundation;

b) severing the at least one point of temporary union; and c) pivoting the at least one garage support member out from under the garage.

* * * * *